US005379520A

United States Patent [19]

Collins

[11] Patent Number: 5,379,520

[45] Date of Patent: Jan. 10, 1995

[54] TOOL/SHEATH LOCKING ASSEMBLY

[75] Inventor: Walter W. Collins, North, S.C.

[73] Assignee: Seaquest, Inc., Carlsbad, Calif.

[21] Appl. No.: 55,515

[22] Filed: Apr. 30, 1993

[51] Int. Cl.[6] ..... B26B 29/02

[52] U.S. Cl. ..... 30/162; 30/151; 224/232

[58] Field of Search ..... 30/151, 162, 143, 339; 224/232

[56] References Cited

U.S. PATENT DOCUMENTS

| | | | |
|---|---|---|---|
| 2,391,574 | 12/1945 | Housinger | 30/151 |
| 2,527,710 | 10/1950 | Davidson, Jr. | 30/143 |
| 2,901,823 | 9/1959 | Widen | 30/151 |
| 3,524,570 | 8/1970 | Seguine | 30/151 |
| 4,404,747 | 9/1983 | Collins | 30/151 |
| 4,835,863 | 6/1989 | Salandre | 30/143 |
| 4,854,044 | 8/1989 | Collins | 30/151 |
| 5,067,239 | 11/1991 | Collins | 30/151 |
| 5,092,046 | 3/1992 | Collins | 30/151 |
| 5,123,167 | 6/1992 | Kelley | 30/151 |

*Primary Examiner*—Richard K. Seidel
*Assistant Examiner*—Hwei-Siu Payer
*Attorney, Agent, or Firm*—Leatherwood Walker Todd & Mann

[57] ABSTRACT

A knife/sheath locking assembly for locking a knife on either side from accidental disengagement from within a sheath. The sheath, molded as a single unit, includes a lever angled to engage a band circumventing the knife handle proximal to the blade. The knife may only be removed from the sheath upon depressing one end of the lever while simultaneously withdrawing the knife.

6 Claims, 2 Drawing Sheets

Fig. 1
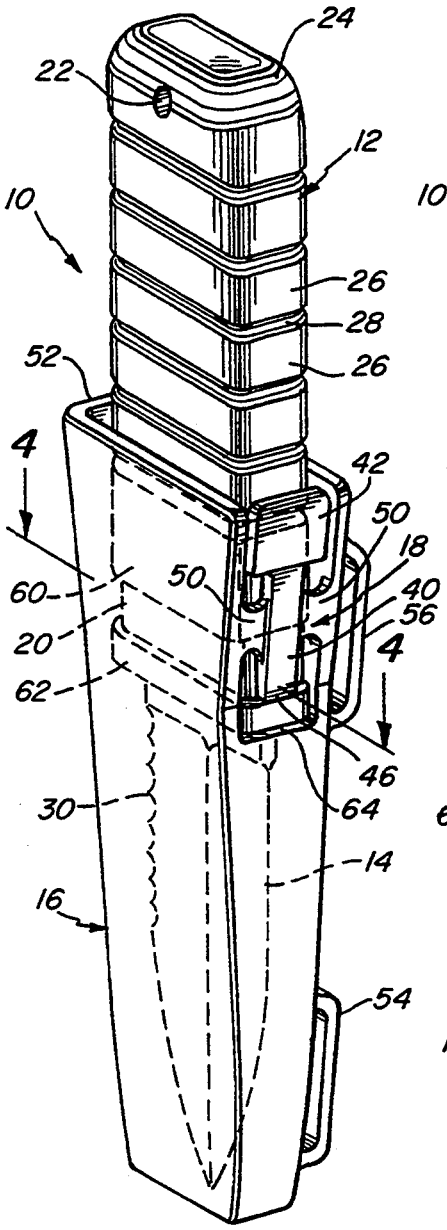
Fig. 2
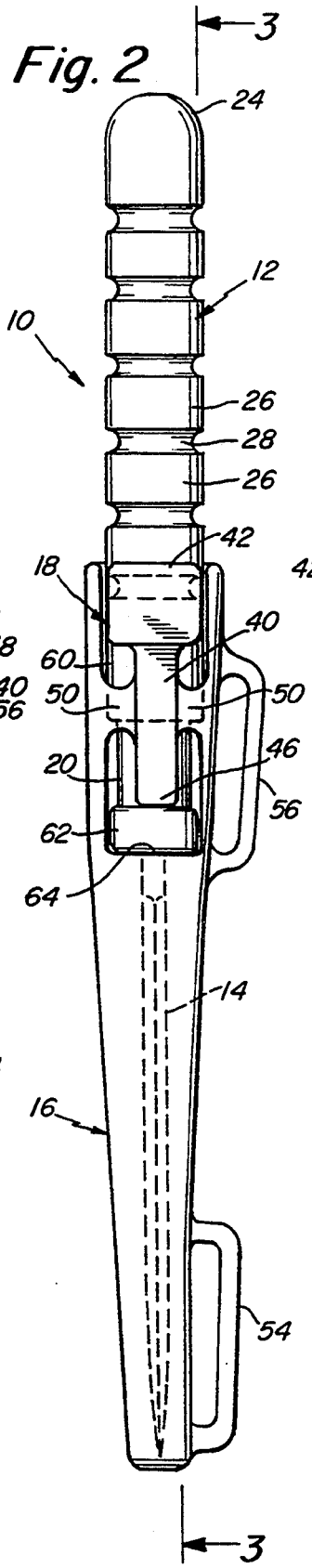
Fig. 3
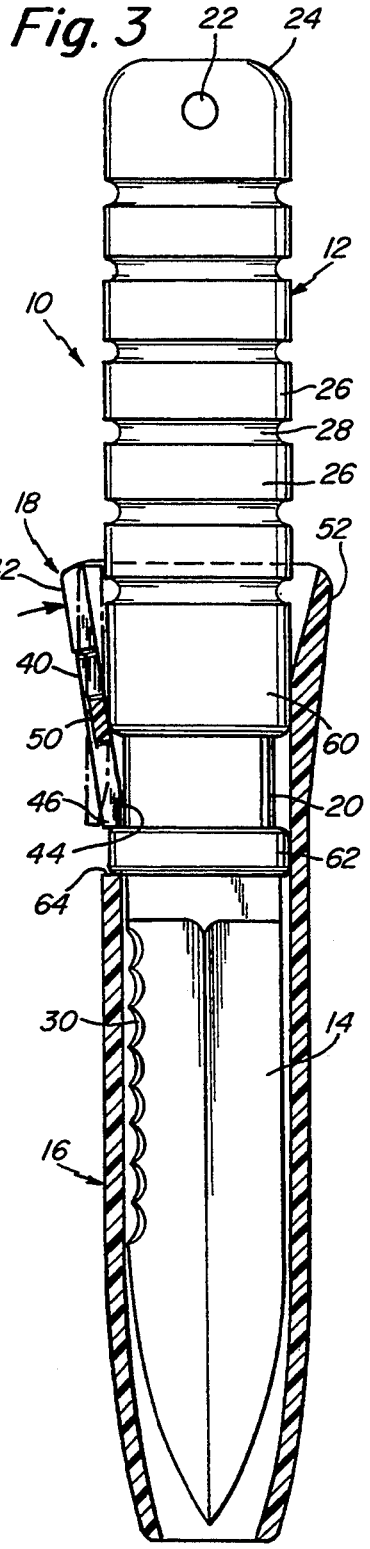
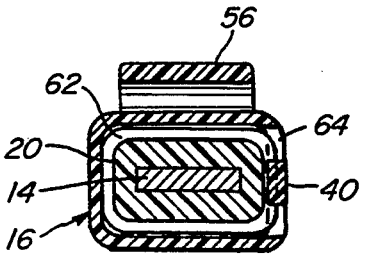
Fig. 4

TOOL/SHEATH LOCKING ASSEMBLY

BACKGROUND OF THE INVENTION

1. Field of the Invention

This invention relates to a new and improved integrally molded assembly for locking a tool in a sheath.

2. Background of the Invention

A variety of mechanical devices have been developed for inter-engaging a tool, such as a knife, and sheath while still permitting a quick release. Such interlocking features are important for sporting uses and are particularly important for underwater divers who must be able to insert and remove a knife from a sheath quickly and efficiently while being assured that the knife will not slip from the sheath.

A variety of devices have been developed including one in which the blade is retained in the sheath by frictional engagement. That arrangement is not satisfactory for underwater use because the blade may readily lose frictional engagement with the sheath and slide out while the swimmer is moving through the water.

Other devices include knife and sheath assemblies with buttons which are spring loaded to snap into engagement. Such knife and sheath combinations are exemplified by Housinger, U.S. Pat. No. 2,391,574, issued Dec. 25, 1945, Widen, U.S. Pat. No. 2,901,823, issued Sep. 1, 1959, Collins, U.S. Pat. No. 4,405,747, issued Sep. 20, 1983, and Collins, U.S. Pat. No. 4,854,044, issued Aug. 8, 1989. Each of these issued patents provide interlocks in which spring loaded detents interengage a sheath or similar holder. While such arrangements provide an interlock with a rapid release mechanism, the constructions either involve an assembly of a number of components or involve the use of separate moving parts when in use. For example, in the Widen patent, U.S. Pat. No. 2,901,823, there is provided a spring detent which is secured to a sheath by a riveting assembly which, in combination with a sliding bolt in the handle, provides a mechanism for release. The Collins patents, U.S. Pat. Nos. 4,404,747 and 4,854,044, have a spring loaded button assembled into the handle with the button adapted to project into a hole in the sheath. These units require incorporating a number of different components into an assembly. The Housinger patent, U.S. Pat. No. 2,391,574, also involves an assembly of a spring loaded detent which is riveted to a sheath.

Collins, U.S. Pat. No. 5,067,239, issued Nov. 26, 1991, provides a laterally sliding lock mechanism on the sheath to release the knife from within. Some users, however, find using a lateral thumb motion to release a knife difficult or uncomfortable. Furthermore, the tab arrangement has a substantially one-sided sheath arrangement which may not be preferred by all users.

SUMMARY OF THE PRESENT INVENTION

It is an object of the present invention to provide a tool and sheath combination that is simple and inexpensive to make, but which, nonetheless, securely holds the tool in the sheath when it is supposed to be secured, while providing quick release at an appropriate time.

A further object of the present invention is to provide a tool, such as a knife, and sheath combination which can be used by either a right-handed or left-handed person with the knife capable of being inserted in the sheath with either the blade facing forwardly or facing rearwardly.

A still further object of the present invention is to provide an improved one-piece injection molded sheath formed in a single operation.

A still further object of the present invention is to provide a sheath construction for use with tools or knives having handles so that only a single motion is required to disengage the tool or knife.

To accomplish these and other objects, the present invention provides a tool/sheath combination having an assembly releasably securing the tool in the sheath. The assembly comprises an integrally molded lever secured to the sheath near the opened end of the sheath at a fulcrum integrally formed with the sheath. The lever projects into the opening in an interferring fit with the tool. By applying a force to the non-engaging end of the lever, the tool may be released.

These and other objects and features of the present invention will be better understood and appreciated from the following detailed description of one basic embodiment thereof, selected for the purpose of illustration and shown in accompanying drawings, in which:

BRIEF DESCRIPTION OF THE DRAWING

FIG. 1 is a perspective view showing the present invention wherein the dotted lines illustrate the blade and a lower portion of the handle positioned within the sheath;

FIG. 2 shows a side elevational view of the invention;

FIG. 3 shows a front elevational view of the present invention taken along the line 3—3 of FIG. 2;

FIG. 4 shows a cross-sectional view of the present invention taken along the line 4—4 of FIG. 1.

DETAILED DESCRIPTION OF THE PRESENT INVENTION

Figure 5:
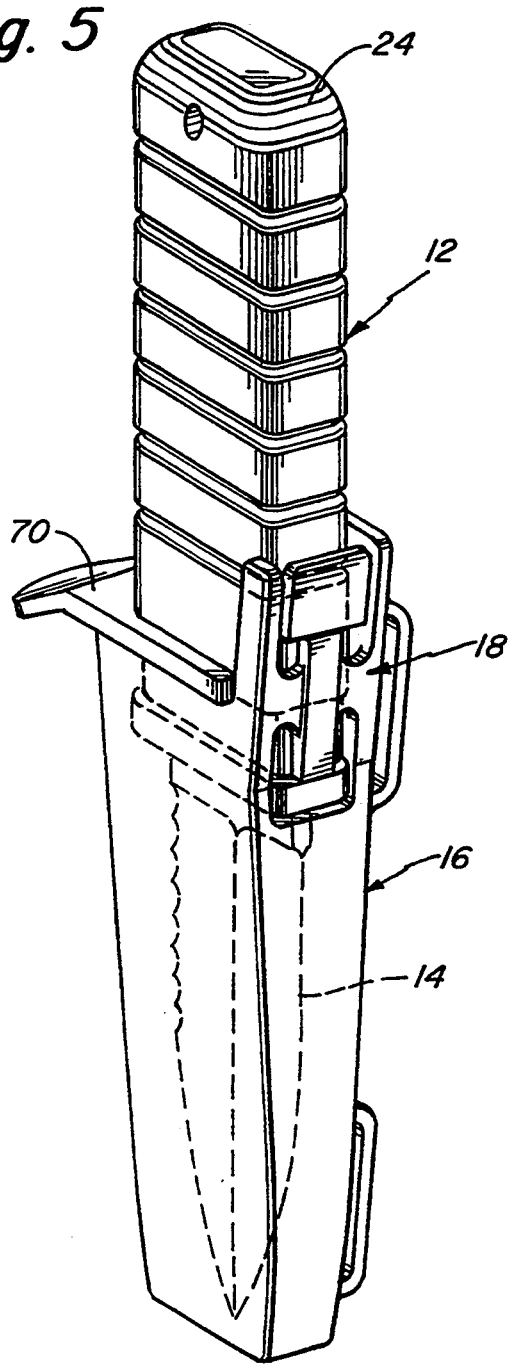
FIG. 5 is a perspective view showing the present invention in use with a knife having a finger guard and a sheath appropriately shaped to receive it.

The overall arrangement of the present invention may be best seen in FIGS. 1 and 3. A tool, such as a knife 10 having a handle 12 and blade 14, is designed to be locked within a sheath 16. The sheath 16 has a locking assembly 18 which secures the appropriately shaped knife 10 as shown.

Many features of the knife 10 illustrated are not necessary for proper functioning of the locking assembly 18. The required elements for use with the locking assembly 18 include a raised band 62 on the handle 12 proximate to the blade 14. Some of the optional features include a bore 22 in the handle 12 at the butt end 24. The bore 22 is shaped to receive a cable loop or cord. The handle 12 may have a series of raised surfaces 26 separated by channels 28 which form a grip area for the user. The combination of raised surfaces 26 and channels 28 provides a more secure handle 12 for the user than a knife 10 having a handle with a smooth surface. The blade 14 as shown may also have a serrated edge 30.

The handle 12 is made from a suitable plastic or resin which provides strength and resists deformation. The sheath 16 is molded as a single unit including the locking assembly 18. The material used for the sheath 16 may be the same plastic or resin used for the handle 12 which, in addition to providing the strength necessary to prevent damage, should also have the resiliency and provide flexibility necessary for the locking assembly 18.

The locking assembly 18 comprises a lever 40 having a button 42 at one end and an inward face 44 (FIG. 3) at an engagement end 46. The sheath 16 is molded so that a pair of arms 50, forming the fulcrum or pivot of the lever 40, extend outwardly from the center portion of the lever 40 (FIG. 2). Each arm 50 may be narrower at its center than its ends. The shape provides the spring-like characteristics necessary for the locking assembly 18. The lever 40 and arms 50 are further molded at a slight angle so that the engagement end 46 is directed inwardly while the button 42 is angled outwardly (FIG. 3). The upper portion of the sheath 52 on the side opposite the locking assembly 18 may be symmetrically shaped. The opening of the sheath 16 is flared to guide the knife 10 as it is inserted into the sheath 16.

The sheath 16 may have a variety of features not required for use of the locking mechanism 18. For example, a pair of loops 54 and 56 on the sheath 16 secure the sheath 16 to a belt.

A pair of spaced raised bands 60 and 62 define a recessed annular surface 20. The bands 60 and 62 may form an extension of the series of raised surfaces 26 from one end 24 of the handle to the other. The depth of the recess formed by bands 60 and 62 must be deep enough to engage end 46 and prevent accidental release of the knife 10.

When the knife 10 is inserted into sheath 16, the band 62 first pushes aside the lever 40 at the engagement end 46. As the band 62 slides beyond the engagement end 46, it is stopped by a lip 64 formed by an exposed edge of the sheath 16 facing the engagement end 46 of the lever 40. Thus, the lip 64 limits the distance the knife 10 may be inserted into the sheath 16. The band 62 should be of a width such that upon clearance of the inward face 44 of the lever 40 and abutment against the lip 64, the lever 40 snaps into locking engagement against the handle 12 along the surface 20. The inward face 44 presses against the surface 20 while the engagement end 46 and the lip 64 abut either side of the band 62.

To release the knife 10, the button 42 of the lever 40 is pressed inwardly toward the knife 10 until the lever 40 is parallel as shown in phantom in FIG. 3. This motion pivots the engagement end 46 from against the band 62 which permits the user to remove the knife 10 with a single hand in substantially a single motion. The user simply slides his thumb from the button 42 onto the handle 12 after the initial withdrawal of the knife 10.

The system shown in FIGS. 1–4 provides for a sheath 16 usable by either a right-handed or left-handed diver. FIG. 5, on the other hand, illustrates a knife with a finger guard 70 which provides safety against accidental cuts. The basic locking assembly 18, however, remains the same.

Various changes and modifications and equivalents of the embodiments described above and shown in the drawings may be made within the scope of this invention. For example, teeth may be provided on the recess 20 to engage matching teeth on the inward face 44. Furthermore, a second locking mechanism 18 may be provided on the side 52 of the sheath 16 as shown. Finally, while a knife 10 has been described, any tool having a handle capable of locking with the sheath 16 may be used with the invention. Thus, it is intended that all matters contained in the above description or shown in the accompanying drawings are presented by way of example only and are intended to be interpreted in an illustrative and not limited sense.

What is claimed:

1. A knife/sheath combination, comprising:

a sheath;

a knife to be inserted in said sheath, said knife having a handle;

a raised band on said handle;

a movable lever secured to said sheath; and said lever having an engagement end and an opposite button end so that said engagement end is engageable with said raised band when said knife is fully inserted within said sheath, thereby preventing removal of said knife, and wherein removal of said knife from said sheath requires urging of said button end of said lever in a direction toward said handle of said knife.

2. The combination as defined in claim 1, wherein said lever and said sheath are molded together as an integral unit.

3. The combination as defined in claim 1, wherein said knife further includes an outwardly extending finger guard.

4. The combination as defined in claim 1, wherein said raised band circumscribes said handle of said knife.

5. The combination as defined in claim 1, wherein said engagement end of said lever is normally disposed for engaging said raised band.

6. The combination as defined in claim 1, wherein said handle of said knife has at least two opposing sides and wherein said raised band is provided on each of said two opposing sides.

* * * * *